US005951446A

United States Patent [19]

Monforte

[11] Patent Number: 5,951,446

[45] Date of Patent: Sep. 14, 1999

[54] WEIGHTED CONDITIONING GARMENTS

[76] Inventor: Matthew L. Monforte, 12 Ashwood Dr., Hamilton, N.J. 08618

[21] Appl. No.: 09/094,519

[22] Filed: Jun. 15, 1998

[51] Int. Cl.[6] ..... A63B 21/065

[52] U.S. Cl. ..... 482/105; 2/456

[58] Field of Search ..... 482/105; 2/2.5, 2/455, 456

[56] References Cited

U.S. PATENT DOCUMENTS 1,532,362 4/1925 Bailey ..... 2/2.5

*Primary Examiner*—John Mulcahy
*Attorney, Agent, or Firm*—Martin Sachs

[57] ABSTRACT

Weighted conditioning garments to help an individual lose weight and/or increase muscle strength and stamina include a plurality of weight members affixed to at least two elongated flexible members formed in the shaped of an article of clothing with a fastening device to securely place the article of clothing upon the individual.

20 Claims, 6 Drawing Sheets

WEIGHTED CONDITIONING GARMENTS

BACKGROUND OF THE INVENTION

1. Field of the Invention

The present invention relates to weighted exercise garments and in particular to an article of clothing fabricated from a plurality of weight members affixed to at least two elongated flexible members shaped to form an article of wearing apparel.

2. Description of the Relevant Art

The art abounds with numerous types of apparel that are provided with pockets or other holding devices wherein weights may be affixed to or placed within the apparel. The apparel is worn by an individual with the added increase in weight, so that the individual wearing the apparel uses additional energy thereby strengthening their muscles and/or causing them to reduce their weight. However, none of the garments found in the prior art include the weights interwoven within the garment itself. Typical of a garment, wherein the weights are an integral therewith, is disclosed in U.S. Pat. No. 5,659,898 issued to Charles Bell, Jr., on Aug. 26, 1997. The apparel disclosed therein includes an elastic bodysuit constructed of two breathable, durable, elastic layers quilted together over a series of flexible weights.

The instant invention overcomes the shortcomings found in the prior art by having the weights used to form the garment material intertwined with elongated flexible members that are affixed to the individual weights and formed into a garment suitable for wearing by an individual while exercising or performing daily chores.

SUMMARY OF THE INVENTION

It is an object of the present invention to provide a garment that may be worn by an individual under personal outer garments while the individual is performing his/her normal everyday tasks.

It is yet another object of the present invention to provide a garment having multiple portions or sections that may be affixed to either an arm or leg of an individual to help strengthen the muscles in that particular area.

The foregoing and other objects and advantages of the instant invention will appear from the description to follow. In the description reference is made to the accompanying drawing, which forms a part hereof, and in which is shown by way of illustration, a specific embodiment in which the invention may be practiced. This embodiment will be described in sufficient detail to enable those skilled in the art to practice the invention, and it is to be understood that other embodiments may be utilized and that structural changes may be made without departing from the spirit and scope of the invention. The following detailed description is, therefore, not to be taken in a limiting sense, and the scope of the present invention is best defined by the appended claims.

BRIEF DESCRIPTION OF THE DRAWING

In order that the invention may more fully understood, it will now be described, by way of example with reference to the accompanying drawing in which.

DESCRIPTION OF THE PREFERRED EMBODIMENTS

Figure 1:
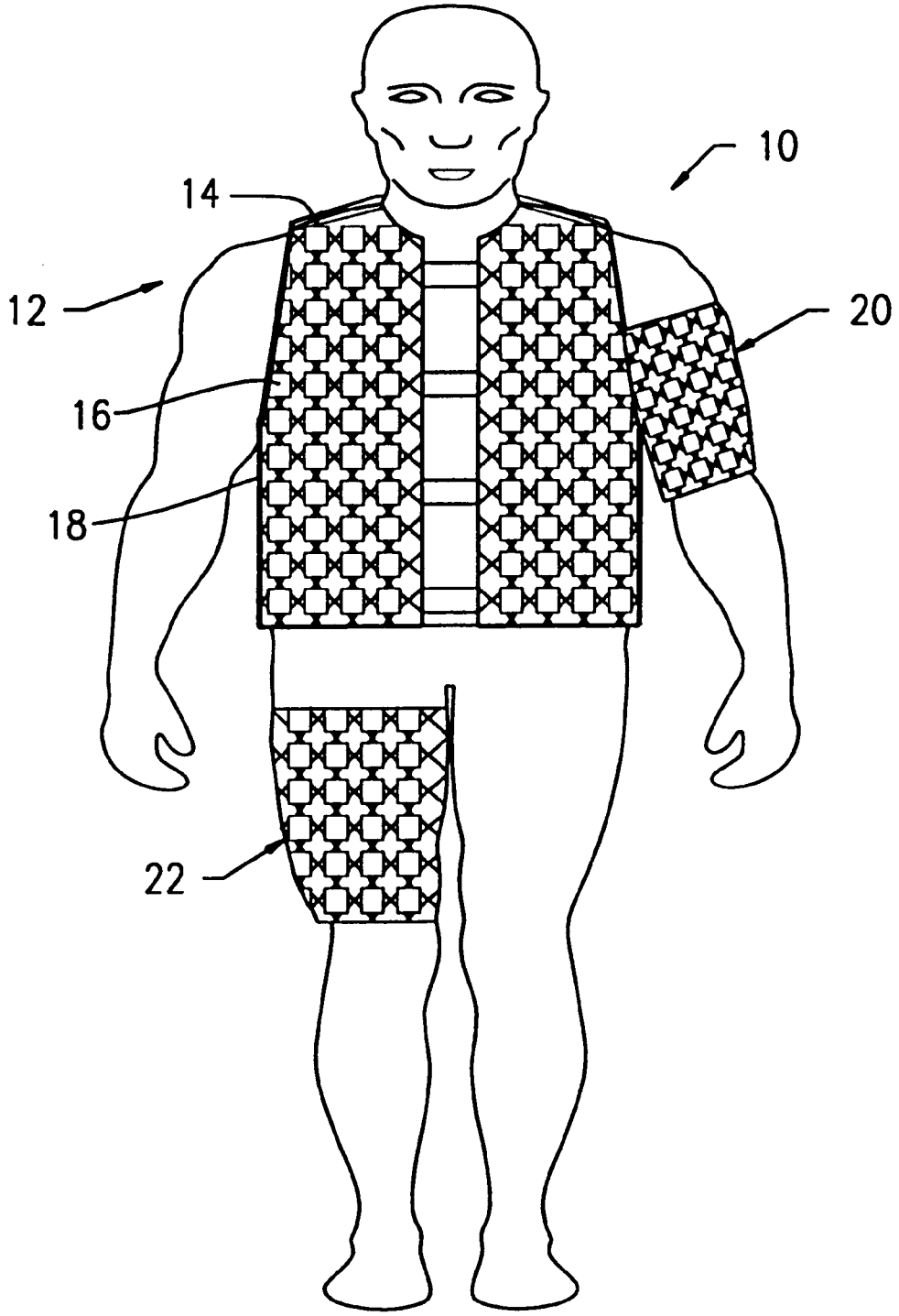
FIG. 1 is a pictorial representation of the garment being worn by an individual, according to the principles of the present invention.

Referring now the figures, and in particular to FIG. 1, there is shown a weight conditioning garment 10 worn by an individual 12. The vest or garment 14 includes a plurality of weight members 16 affixed to flexible members 18, which may be fabricated from a plurality of thin metallic wires or a braided hemp or cotton.

The weight members 16 may be fabricated from brass or any other material that is not subject to rust or deterioration when coming into contact by perspiration or hand oils.

A sleeve or arm band 20 may be utilized to strengthen the muscles in the arm and may be worn on either the left or the right arm of an individual. A leg portion 22 of the garment may be fabricated in the same manner and may be placed over either or both legs of the individual 12 to increase the strength of the limb(s) while walking or exercising.

Figure 2:
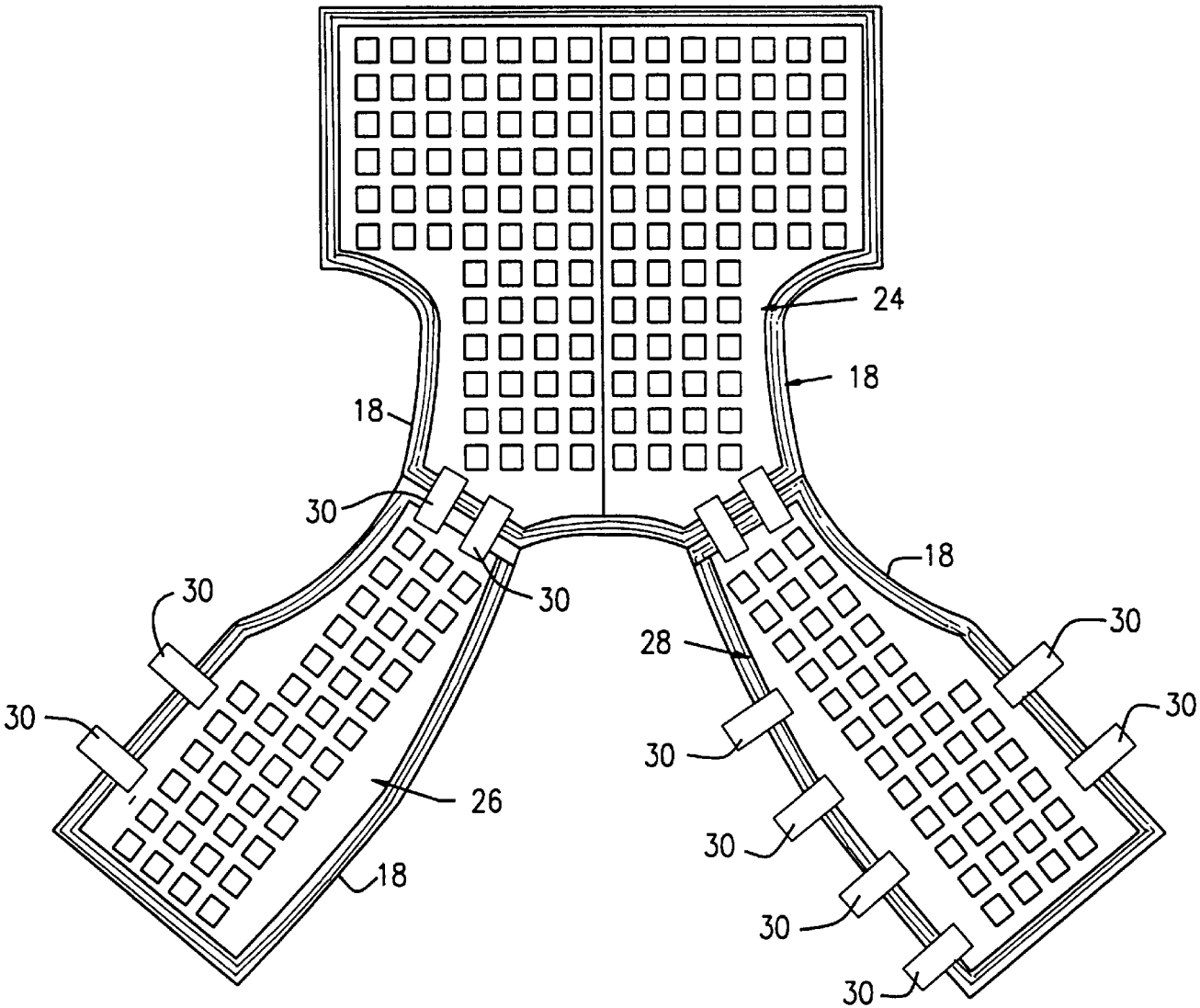
FIG. 2 is a top plan view of the garment shown in FIG. 1 with the individual parts affixed to each other to form the vest shown in FIG. 1.

Referring now to FIG. 2, which shows the garment made in several pieces that includes a back member 24 and side portions 26 and 28. The back member 24 and the side portions 26 and 28 of the garment 10 are fastened by means of a fastening device shown more clearly in detail in FIGS. 4 and 5. The flexible members 18 which connect the weight members 16 are omitted from the top plan view of FIG. 2 for clarity.

Figures 3A, 3B, 3C:
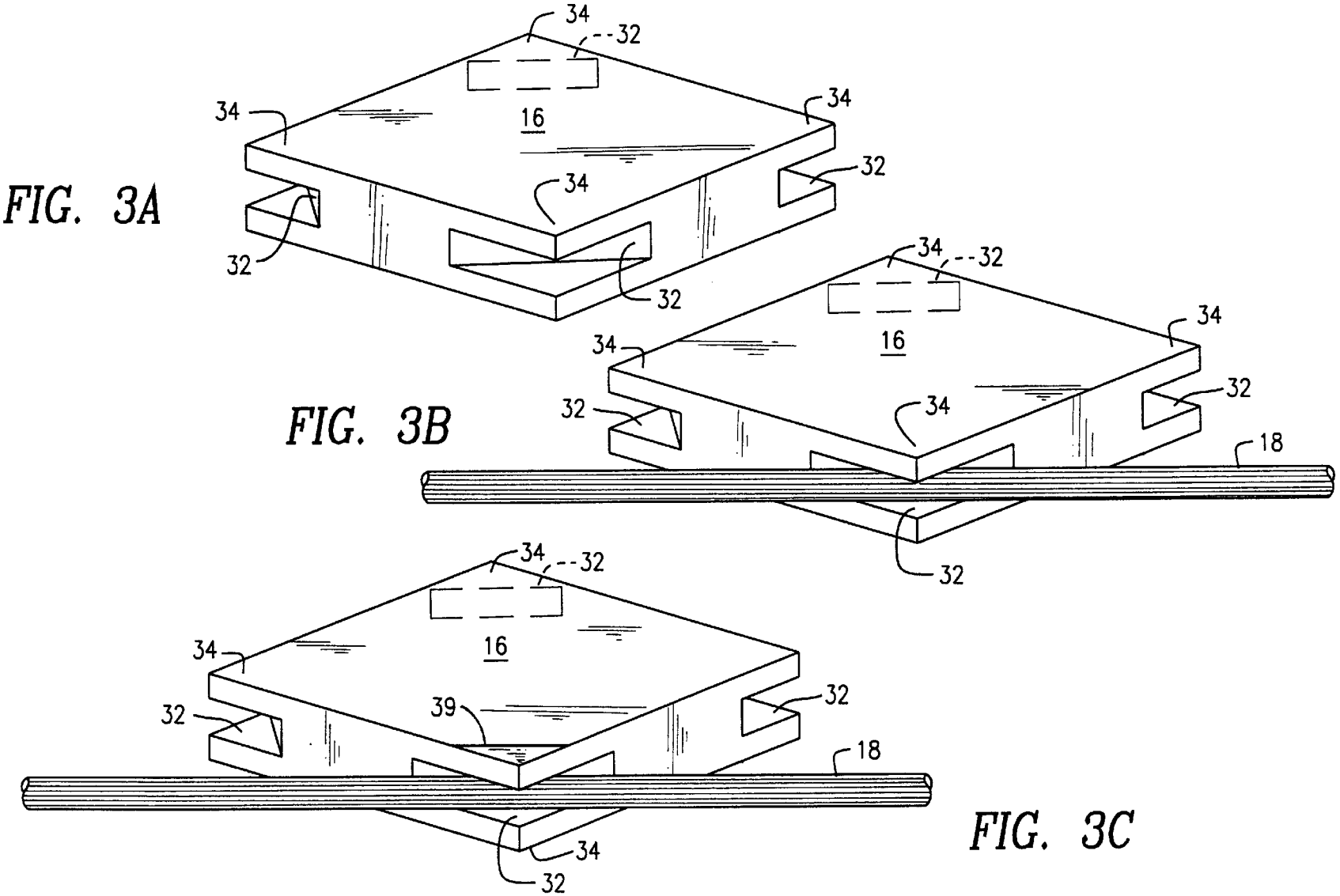
FIG. 3A is a perspective view of one of the individual weight members of which a plurality is used to form the garment.
FIG. 3B is a perspective view of weight member having a flexible member disposed within the corner slot or channel formed within the weight member.
FIG. 3C is perspective view of the weight member, wherein the corner channel is formed or swaged over the flexible member to maintain the weight in position.

Referring now to FIG. 3A, which is a greatly enlarged perspective view of the weight member 16 and the flexible member 18. The weight member 16 is seen to include channels or grooves 32 which are cut diagonally across the four corners 34 of the weight member 16. One of the flexible members 18 is inserted into the channels or grooves 32, as is shown in FIG. 3B, and then swaged 33 or formed over the member 18, as is shown in FIG. 3C, to maintain the weight member 16 in position on the flexible member 18.

Figure 4:
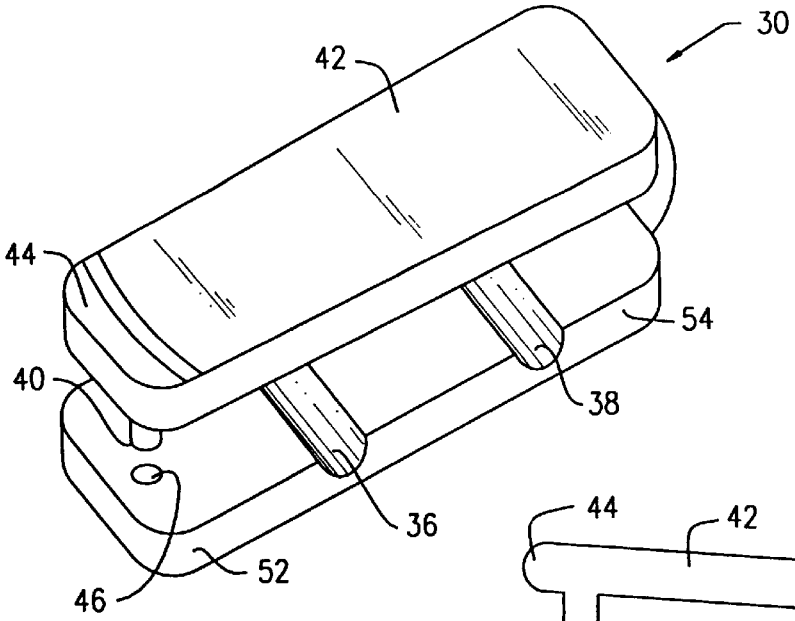
FIG. 4 is a perspective view of a fastening device for connecting the parts of the garment together, as well as, fastening the fronts of the garment together.
Figure 5:
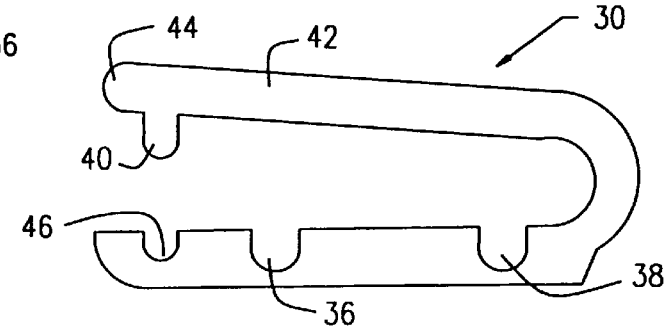
FIG. 5 is a side view in elevation of the fastening device shown in FIG. 4.

Referring now to FIG. 4, there is shown the fastening device 30, which is seen to include grooves or channels 36 and 38 suitable for receiving the flexible members 18 therein and further includes a protrusion 40 downwardly extending from the top portion 42 of the fastening device 30. The top portion 42 may also be provided with a tab 44 located on the distal edge thereof, to make it easier to open the fastening device 30. A mating aperture 46 disposed proximate the distal end 52 of the base portion 54 of the fastening member 30 is adapted to cooperate with the protrusion 40 disposed on the bottom surface of the top portion 42 of the fastening device 30. The fastening device 30 may readily be opened and closed to form the garment 14, as well as, fasten the garment 14 upon the individual 12 wearing it.

Figure 6:
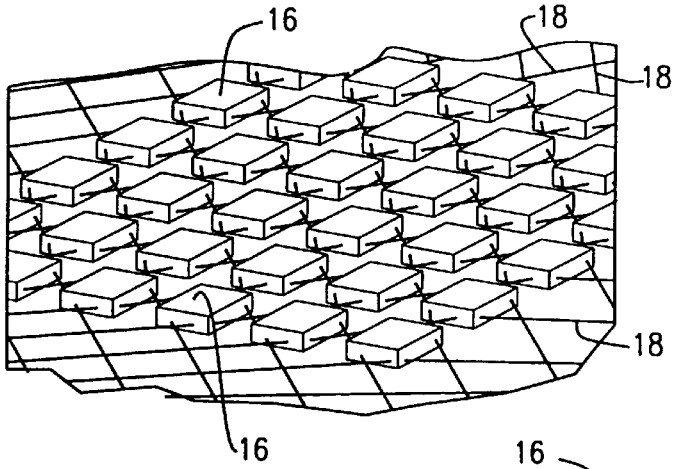
FIG. 6 is a perspective view of the weight members affixed to the flexible members forming the material for an article of apparel.

By referring to FIG. 6, which shows a perspective view of the weight members affixed to the flexible members 18 to form the material for an article of apparel, it may be readily seen how the flexible members 18 are connected to the weight members 16.

Figure 7:
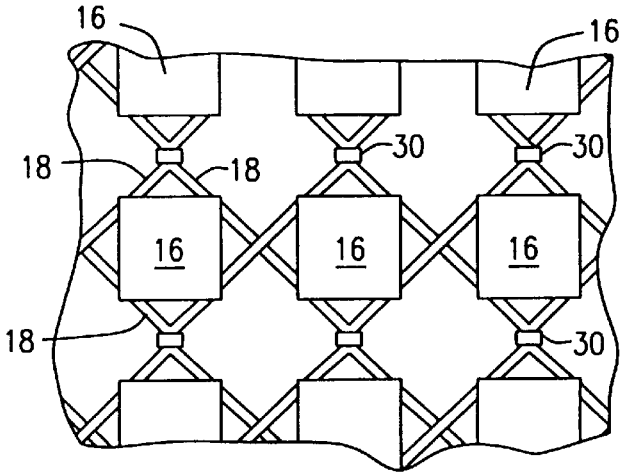
FIG. 7 is a top plan view of the weight members affixed to the flexible members as shown in FIG. 6.

Referring to FIG. 7, one may readily see the top plan view of the weights 16 fastened to the flexible members 18 with a fastening device 30 placed at the intersection or cross-over of the flexible members 18. Of course the grooves 36 and 38 are modified to accommodate the position of the flexible members 18.

Figure 8:
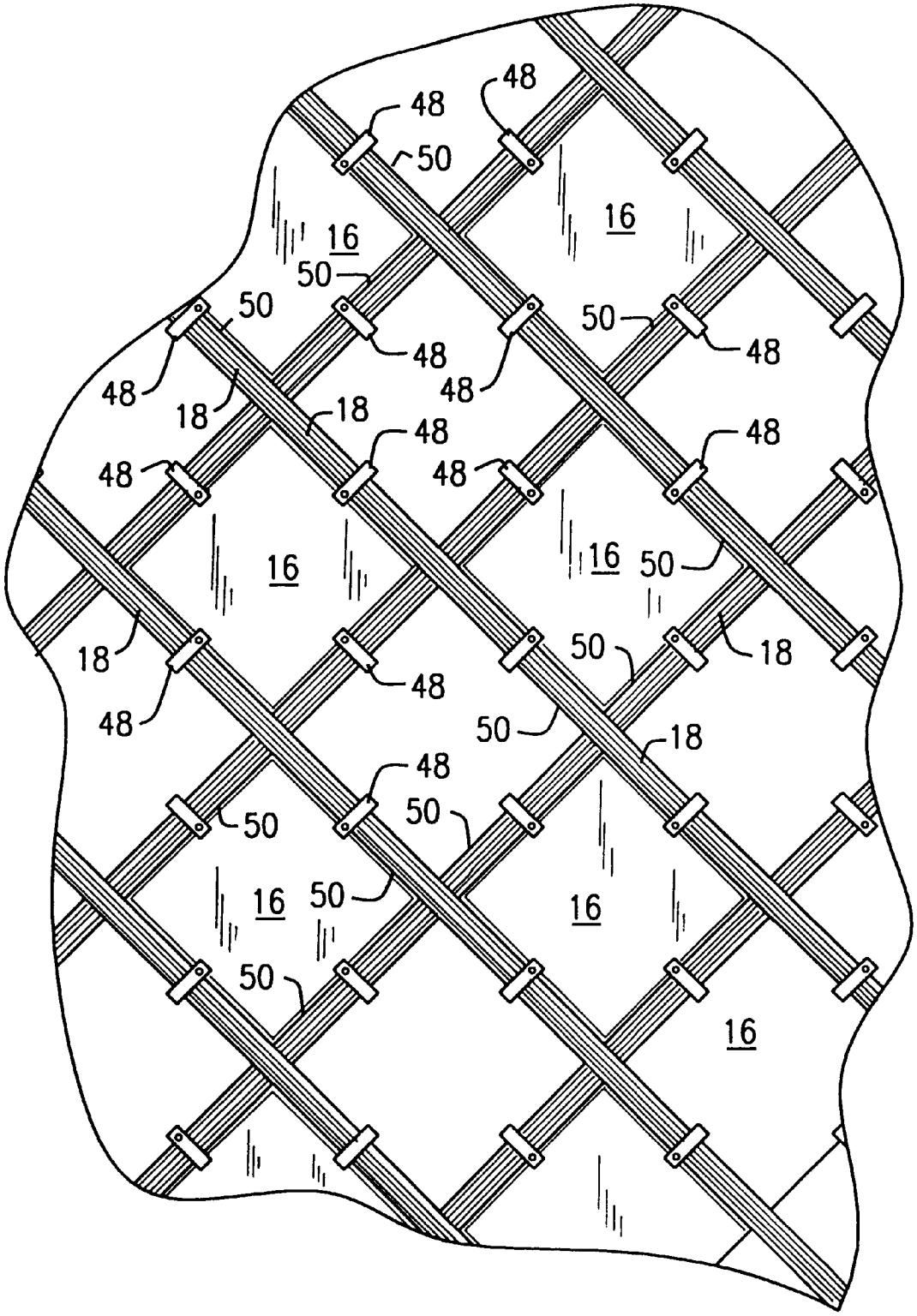
FIG. 8 is a top plan view of an alternative embodiment of the weight members showing other means to affixing the weight member to the flexible members.

An alternative embodiment of the weight members 16 is shown greatly enlarged in FIG. 8 showing an other method of fastening the weight members 16 to the flexible members 18. In the alternative embodiment shown in FIG. 8, the weight members 16 are provided with U-shaped extension tab members 48, which encircle the flexible members 18 affixing it to the weight members 16, in a conventional manner, e.g. screws, rivets, or spot welds.

Figure 9:
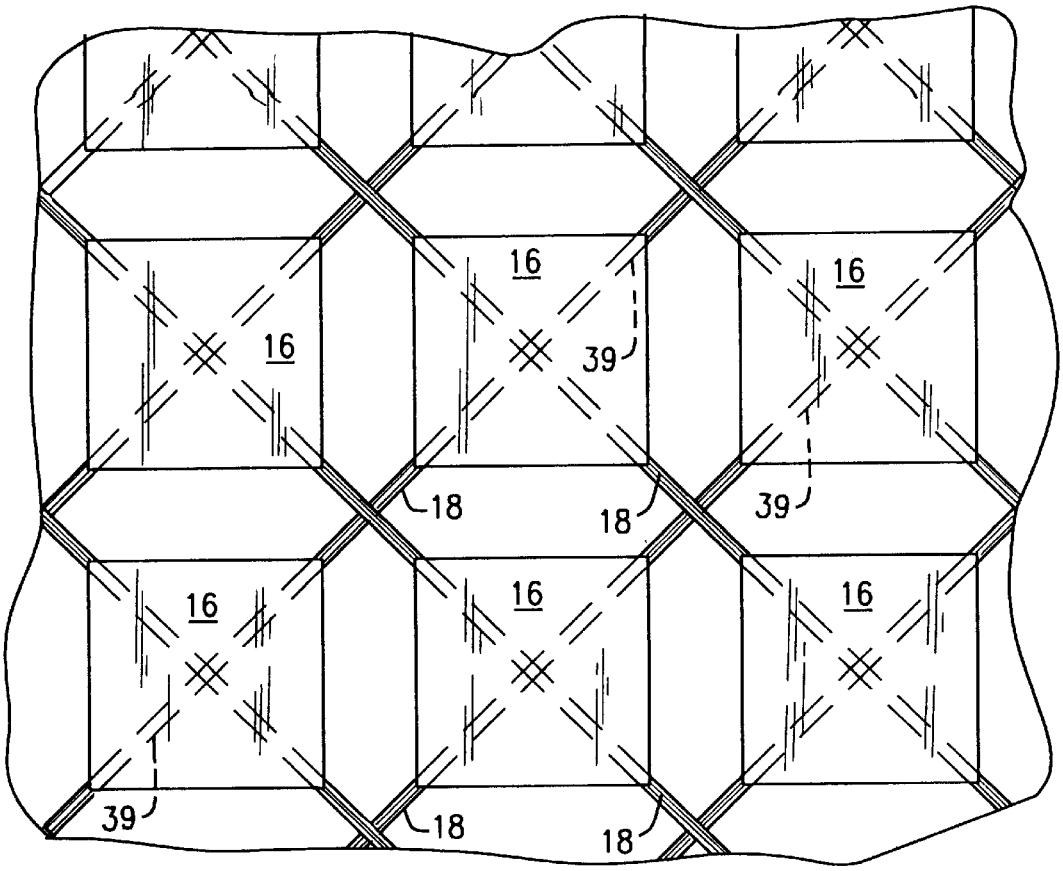
FIG. 9 is a top plan view of another alternative construction utilizing a different weight members affixed to flexible members.

Referring now to FIG. 9 which shows a portion of yet another alternative embodiment of the enlarged weight members 16 affixed to the flexible members 18 with an X-shaped groove or channel 39 into which the flexible members 18 are retained by forming or swaging in a manner similar to that described in conjunction with FIGS. 3A–3C.

Figure 10:
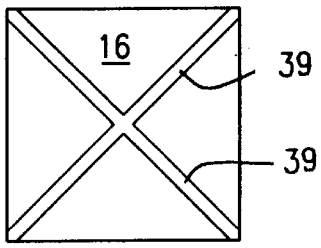
FIG. 10 is a bottom plan view of the weight member utilized in FIG. 9, which has an X-shaped channel formed therein to receive the flexible members.
Figure 11:
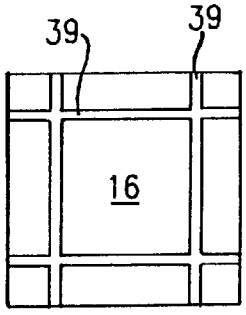
FIG. 11 is a bottom plan view of the weight member, which may be utilized in the configuration shown in FIG. 7, that has a rectangularly shaped channel formed therein to receive the flexible members.

FIG. 10 shows the under side or bottom of the weights members 16 shown in FIG. 9.

Hereinbefore has been disclosed a weight containing garment wherein the material utilized includes a plurality of weights affixed to flexible members wherein an individual may wear the garment under an outer garment while exercising or performing daily chores to strengthen muscles or reduce weight.

It will be understood that various changes in the details, materials, arrangements of parts and operating conditions which have been herein described and illustrated in order to explain the nature of the invention may be made, by those skilled in the art, within the principles and scope of the instant invention.

Having thus set forth the nature of the invention, what is claimed is:

1. A weighted conditioning garment, comprising:

A. a plurality of generally flat weight members with a face and corners, each said weight member being provided with means for receiving and retaining at least two flexible members thereon, said means comprising channels formed in a face or corner of each said weight member;

B. flexible members having a shape suitable for being received and retained by each of said weight members, said flexible members being formed in a mesh arrangement wherein four of said flexible members may be retained by each said weight member; and C. fastening means for fastening a garment formed by said flexible members and said weight members on an individual.

2. A weighted conditioning garment, according to claim 1, wherein each said means for receiving and retaining at least two flexible members within each said weight member are channels formed as an "X".

3. A weighted conditioning garment, according to claim 1, wherein said means for receiving and retaining at least two flexible members on each said weight member are channels formed as a rectangle.

4. A weighted conditioning garment, according to claim 1, wherein each said weight member is rectangularly-shaped and said means for receiving and retaining at least two flexible members within said weight member are channels formed diagonally across each corner of said weight member.

5. A weighted conditioning garment, according to claim 3 or 4, wherein said means for receiving and retaining at least two flexible members within said weight member is provided by forming said channel over said flexible members after insertion within said channels.

6. A weighted conditioning garment, according to claim 1, further including a second fastening means for binding two of said flexible members together at the intersection thereof.

7. A weighted conditioning garment, according to claim 1, wherein each said flexible member is circularly-shaped in cross section.

8. A weighted conditioning garment, according to claim 7, wherein each said flexible member is fabricated from a plurality of fine wires to form a cable.

9. A weighted conditioning garment, according to claim 7, wherein each said flexible member is fabricated from an electrically non-conducting material.

10. A weighted conditioning garment, according to claim 1, wherein said fastening means is a locking clamp.

11. A weighted conditioning garment, according to claim 1, wherein said fastening means is a strip of Velcro disposed between openings within said flexible members.

12. A weighted conditioning garment, according to claim 1, wherein said garment is in the form of a sleeveless vest.

13. A weighted conditioning garment, according to claim 1, wherein said garment is in the form of a sleeve.

14. A weighted conditioning garment, according to claim 1, wherein said garment is in the form of leg cover.

15. A weighted conditioning garment, comprising:

A. a plurality of generally flat weight members, each said weight member having;

a) a rectangular shape, and b) means for receiving and retaining at least two flexible members in channels formed diagonally across each corner of said weight member;

B. flexible members being circularly-shaped in cross section and suitable for being received and retained by each said weight members, said flexible members being formed in a mesh arrangement wherein four of said flexible members may be retained by each said weight member; and C. fastening means in the form of a locking clamp for fastening a garment formed by said flexible members and said weight members on an individual.

16. A weighted conditioning garment, comprising:

A. a plurality of generally flat weight members, each said weight member having;

a) a rectangular shape on a face thereof, and b) means for receiving and retaining at least two flexible members, said means comprising channels formed in a face or corner of each said weight member;

B. flexible members being circularly-shaped in cross section and suitable for being received and retained by each of said weight members, said flexible members being formed in a mesh arrangement wherein four of said flexible members may be retained by each said weight member; and C. fastening means in the form of a locking clamp for fastening a garment formed by said flexible members and said weight members on an individual.

17. A weighted conditioning garment, according to claim 16, wherein said means for receiving and retaining at least two flexible members are channels formed diagonally across each corner of said weight member.

18. A weighted conditioning garment, according to claim 16, wherein each said flexible member is fabricated from a plurality of fine wires to form a cable.

19. A weighted conditioning garment, according to claim 16, wherein each said flexible member is fabricated from an electrically non-conducting material.

20. A weighted conditioning garment, comprising:

A. a plurality of generally flat weight members, each said weight member being;

a) generally rectangularly-shaped and b) having channels formed diagonally across each corner of said weight member for receiving and retaining at least two flexible members;

B. flexible members having a shape suitable for being received and retained by each said weight members, said flexible members being formed in a mesh arrangement wherein four of said flexible members may be retained by each said weight member; and C. fastening means for fastening a garment formed by said flexible members and said weight members on an individual.

* * * * *